US007844453B2

(12) United States Patent
Hetherington

(10) Patent No.: US 7,844,453 B2
(45) Date of Patent: Nov. 30, 2010

(54) ROBUST NOISE ESTIMATION

(75) Inventor: Phillip A. Hetherington, Port Moody (CA)

(73) Assignee: QNX Software Systems Co., Ottawa, Ontario (CA)

( * ) Notice: Subject to any disclaimer, the term of this patent is extended or adjusted under 35 U.S.C. 154(b) by 917 days.

(21) Appl. No.: 11/644,414

(22) Filed: Dec. 22, 2006

(65) Prior Publication Data

US 2007/0265843 A1 Nov. 15, 2007

Related U.S. Application Data

(60) Provisional application No. 60/800,221, filed on May 12, 2006.

(51) Int. Cl.
*G10L 21/02* (2006.01)

(52) U.S. Cl. ..... 704/228; 704/226

(58) Field of Classification Search ..... 704/226, 704/228, 233; 381/94.3
See application file for complete search history.

(56) References Cited

U.S. PATENT DOCUMENTS

| | | | | |
|---|---|---|---|---|
| 4,486,900 | A | 12/1984 | Cox et al. | |
| 4,531,228 | A | 7/1985 | Noso et al. | |
| 4,630,305 | A | 12/1986 | Borth et al. | |
| 4,811,404 | A | 3/1989 | Vilmur et al. | |
| 4,843,562 | A | 6/1989 | Kenyon et al. | |
| 5,012,519 | A * | 4/1991 | Adlersberg et al. | 704/226 |
| 5,027,410 | A | 6/1991 | Williamson et al. | |
| 5,056,150 | A | 10/1991 | Yu et al. | |
| 5,146,539 | A | 9/1992 | Doddington et al. | |
| 5,313,555 | A | 5/1994 | Kamiya | |
| 5,400,409 | A | 3/1995 | Linhard | |
| 5,479,517 | A | 12/1995 | Linhard | |
| 5,485,522 | A * | 1/1996 | Solve et al. | 381/56 |
| 5,495,415 | A | 2/1996 | Ribbens et al. | |
| 5,502,688 | A | 3/1996 | Recchione et al. | |
| 5,526,466 | A | 6/1996 | Takizawa | |

(Continued)

FOREIGN PATENT DOCUMENTS

| | | |
|---|---|---|
| CA | 2158847 | 9/1994 |

(Continued)

OTHER PUBLICATIONS

Avendano, C., Hermansky, H., "Study on the Dereverberation of Speech Based on Temporal Envelope Filtering," Proc. ICSLP '96, pp. 889-892, Oct. 1996.

(Continued)

*Primary Examiner*—David R Hudspeth
*Assistant Examiner*—Shaun Roberts
(74) *Attorney, Agent, or Firm*—Brinks Hofer Gilson & Lione

(57) ABSTRACT

An enhancement system improves the estimate of noise from a received signal. The system includes a spectrum monitor that divides a portion of the signal at more than one frequency resolution. Adaptation logic derives a noise adaptation factor of the received signal. A plurality of devices tracks the characteristics of an estimated noise in the received signal and modifies multiple noise adaptation rates. Weighting logic applies the modified noise adaptation rates derived from the signal divided at a first frequency resolution to the signal divided at a second frequency resolution.

22 Claims, 8 Drawing Sheets

U.S. PATENT DOCUMENTS

| | | | | |
|---|---|---|---|---|
| 5,568,559 | A | 10/1996 | Makino | |
| 5,584,295 | A | 12/1996 | Muller et al. | |
| 5,617,508 | A | 4/1997 | Reaves | |
| 5,677,987 | A | 10/1997 | Seki et al. | |
| 5,680,508 | A | 10/1997 | Liu | |
| 5,692,104 | A | 11/1997 | Chow et al. | |
| 5,701,344 | A | 12/1997 | Wakui | |
| 5,933,801 | A | 8/1999 | Fink et al. | |
| 5,949,888 | A | 9/1999 | Gupta et al. | |
| 6,011,853 | A | 1/2000 | Koski et al. | |
| 6,163,608 | A | 12/2000 | Romesburg et al. | |
| 6,167,375 | A | 12/2000 | Miseki et al. | |
| 6,173,074 | B1 | 1/2001 | Russo | |
| 6,175,602 | B1 | 1/2001 | Gustafsson et al. | |
| 6,192,134 | B1 | 2/2001 | White et al. | |
| 6,199,035 | B1 | 3/2001 | Lakaniemi et al. | |
| 6,405,168 | B1 | 6/2002 | Bayya et al. | |
| 6,434,246 | B1 | 8/2002 | Kates et al. | |
| 6,507,814 | B1 | 1/2003 | Gao | |
| 6,587,816 | B1 | 7/2003 | Chazan et al. | |
| 6,643,619 | B1 | 11/2003 | Linhard et al. | |
| 6,681,202 | B1 * | 1/2004 | Miet et al. | 704/214 |
| 6,687,669 | B1 | 2/2004 | Schrögmeier et al. | |
| 6,766,292 | B1 * | 7/2004 | Chandran et al. | 704/224 |
| 6,782,363 | B2 | 8/2004 | Lee et al. | |
| 6,822,507 | B2 | 11/2004 | Buchele | |
| 6,859,420 | B1 | 2/2005 | Coney et al. | |
| 6,910,011 | B1 | 6/2005 | Zakarauskas | |
| 6,959,056 | B2 * | 10/2005 | Yeap et al. | 375/346 |
| 7,117,149 | B1 | 10/2006 | Zakarauskas | |
| 7,133,825 | B2 * | 11/2006 | Bou-Ghazale | 704/233 |
| 7,171,003 | B1 * | 1/2007 | Venkatesh et al. | 381/66 |
| 7,464,029 | B2 * | 12/2008 | Visser et al. | 704/210 |
| 2001/0028713 | A1 | 10/2001 | Walker | |
| 2002/0071573 | A1 | 6/2002 | Finn | |
| 2002/0176589 | A1 | 11/2002 | Buck et al. | |
| 2003/0040908 | A1 | 2/2003 | Yang et al. | |
| 2003/0191641 | A1 * | 10/2003 | Acero et al. | 704/233 |
| 2003/0216907 | A1 | 11/2003 | Thomas | |
| 2003/0216909 | A1 | 11/2003 | Davis et al. | |
| 2004/0078200 | A1 | 4/2004 | Alves | |
| 2004/0138882 | A1 | 7/2004 | Miyazawa | |
| 2004/0165736 | A1 | 8/2004 | Hetherington et al. | |
| 2004/0167777 | A1 | 8/2004 | Hetherington et al. | |
| 2005/0114128 | A1 | 5/2005 | Hetherington et al. | |
| 2005/0240401 | A1 | 10/2005 | Ebenezer | |
| 2006/0034447 | A1 | 2/2006 | Alves et al. | |
| 2006/0074646 | A1 | 4/2006 | Alves et al. | |
| 2006/0100868 | A1 | 5/2006 | Hetherington et al. | |
| 2006/0115095 | A1 | 6/2006 | Glesbrecht et al. | |
| 2006/0116873 | A1 | 6/2006 | Hetherington et al. | |
| 2006/0136199 | A1 | 6/2006 | Nongpiur et al. | |
| 2006/0251268 | A1 | 11/2006 | Hetherington et al. | |
| 2006/0287859 | A1 | 12/2006 | Hetherington et al. | |
| 2007/0033031 | A1 | 2/2007 | Zakarauskas | |
| 2007/0055508 | A1 * | 3/2007 | Zhao et al. | 704/226 |
| 2009/0276213 | A1 | 11/2009 | Hetherington | |

FOREIGN PATENT DOCUMENTS

| | | | |
|---|---|---|---|
| CA | 2157496 | | 10/1994 |
| CA | 2158064 | | 10/1994 |
| EP | 0 076 687 | A1 | 4/1983 |
| EP | 0 629 996 | A2 | 12/1994 |
| EP | 0 629 996 | A3 | 12/1994 |
| EP | 0 750 291 | A1 | 12/1996 |
| EP | 1 450 353 | A1 | 8/2004 |
| EP | 1 450 354 | A1 | 8/2004 |
| EP | 1 669 983 | A1 | 6/2006 |
| EP | 1 855 272 | A1 | 11/2007 |
| JP | 06269084 | A2 | 9/1994 |
| JP | 06319193 | A | 11/1994 |
| WO | WO 00/41169 | A1 | 7/2000 |
| WO | WO 0156255 | A1 | 8/2001 |
| WO | WO 01/73761 | A1 | 10/2001 |

OTHER PUBLICATIONS

Berk et al., "Data Analysis with Microsoft Excel", Duxbury Press, 1998, pp. 236-239 and 256-259.

Fiori, S., Uncini, A., and Piazza, F., "Blind Deconvolution by Modified Bussgang Algorithm", Dept. of Electronics and Automatics—University of Ancona (Italy), ISCAS 1999.

Learned, R.E. et al., A Wavelet Packet Approach to Transient Signal Classification, Applied and Computational Harmonic Analysis, Jul. 1995, pp. 265-278, vol. 2, No. 3, USA, XP 000972660. ISSN: 1063-5203. abstract.

Nakatani, T., Miyoshi, M., and Kinoshita, K., "Implementation and Effects of Single Channel Dereverberation Based on the Harmonic Structure of Speech," Proc. of IWAENC-2003, pp. 91-94, Sep. 2003.

Puder, H. et al., "Improved Noise Reduction for Hands-Free Car Phones Utilizing Information on a Vehicle and Engine Speeds", Sep. 4-8, 2000, pp. 1851-1854, vol. 3, XP009030255, 2000. Tampere, Finland, Tampere Univ. Technology, Finland Abstract.

Quatieri, T.F. et al., Noise Reduction Using a Soft-Decision Sine-Wave Vector Quantizer, International Conference on Acoustics, Speech & Signal Processing, Apr. 3, 1990, pp. 821-824, vol. Conf. 15, IEEE ICASSP, New York, US XP000146895, Abstract, Paragraph 3.1.

Quelavoine, R. et al., Transients Recognition in Underwater Acoustic with Multilayer Neural Networks, Engineering Benefits from Neural Networks, Proceedings of the International Conference EANN 1998, Gibraltar, Jun. 10-12, 1998 pp. 330-333, XP 000974500. 1998, Turku, Finland, Syst. Eng. Assoc., Finland. ISBN: 951-97868-0-5. abstract, p. 30 paragraph 1.

Seely, S., "An Introduction to Engineering Systems", Pergamon Press Inc., 1972, pp. 7-10.

Shust, Michael R. and Rogers, James C., Abstract of "Active Removal of Wind Noise From Outdoor Microphones Using Local Velocity Measurements", *J. Acoust. Soc. Am.*, vol. 104, No. 3, Pt 2, 1998, 1 page.

Shust, Michael R. and Rogers, James C., "Electronic Removal of Outdoor Microphone Wind Noise", obtained from the Internet on Oct. 5, 2006 at: <http://www.acoustics.org/press/136th/mshust.htm>, 6 pages.

Simon, G., Detection of Harmonic Burst Signals, International Journal Circuit Theory and Applications, Jul. 1985, vol. 13, No. 3, pp. 195-201, UK, XP 000974305. ISSN: 0098-9886. abstract.

Vieira, J., "Automatic Estimation of Reverberation Time", Audio Engineering Society, Convention Paper 6107, 116th Convention, May 8-11, 2004, Berlin, Germany, pp. 1-7.

Wahab A. et al., "Intelligent Dashboard With Speech Enhancement", Information, Communications, and Signal Processing, 1997. ICICS, Proceedings of 1997 International Conference on Singapore, Sep. 9-12, 1997, New York, NY, USA, IEEE, pp. 993-997.

Zakarauskas, P., Detection and Localization of Nondeterministic Transients in Time series and Application to Ice-Cracking Sound, Digital Signal Processing, 1993, vol. 3, No. 1, pp. 36-45, Academic Press, Orlando, FL, USA, XP 000361270, ISSN: 1051-2004. entire document.

* cited by examiner

| | | |
|---|---|---|
| MAX | | **Mx:40** |
| MIN | | **Mn:0.1** |
| Slope | Range | ***Range:39.90*** |
| Critical Var | | **Crit:20** |
| *Computed X Offset* | | *Alpha:43.33* |
| StdErr | Var | Gain |
| 0.00 | 0.00 | 40.00 |
| 1.00 | 1.00 | 36.10 |
| 1.41 | 2.00 | 27.94 |
| 1.73 | 3.00 | 20.30 |
| 2.00 | 4.00 | 14.70 |
| 2.24 | 5.00 | 10.86 |
| 2.45 | 6.00 | 8.24 |
| 2.65 | 7.00 | 6.42 |
| 2.83 | 8.00 | 5.13 |
| 3.00 | 9.00 | 4.18 |
| 3.16 | 10.00 | 3.47 |
| 3.32 | 11.00 | 2.93 |
| 3.46 | 12.00 | 2.50 |
| 3.61 | 13.00 | 2.17 |
| 3.74 | 14.00 | 1.89 |
| 3.87 | 15.00 | 1.67 |
| 4.00 | 16.00 | 1.49 |
| 4.12 | 17.00 | 1.33 |
| 4.24 | 18.00 | 1.21 |
| 4.34 | 18.84 | 1.11 |

| | | |
|---|---|---|
| MAX | | **Mx:40** |
| MIN | | **Mn:0.1** |
| Slope | Range | ***Range:39.90*** |
| Critical Var | | **Crit:07.4** |
| *Computed X Offset* | | *Alpha:43.33* |
| StdErr | Var | Gain |
| 0.00 | 0.00 | 40.00 |
| 1.00 | 1.00 | 22.37 |
| 1.41 | 2.00 | 9.68 |
| 1.73 | 3.00 | 5.01 |
| 2.00 | 4.00 | 3.02 |
| 2.24 | 5.00 | 2.02 |
| 2.45 | 6.00 | 1.45 |
| 2.65 | 7.00 | 1.10 |
| 2.83 | 8.00 | 0.87 |
| 3.00 | 9.00 | 0.71 |
| 3.16 | 10.00 | 0.60 |
| 3.32 | 11.00 | 0.51 |
| 3.46 | 12.00 | 0.45 |
| 3.61 | 13.00 | 0.40 |
| 3.74 | 14.00 | 0.36 |
| 3.87 | 15.00 | 0.32 |
| 4.00 | 16.00 | 0.30 |
| 4.12 | 17.00 | 0.27 |
| 4.24 | 18.00 | 0.26 |
| 4.34 | 18.84 | 0.24 |

| | | | |
|---|---|---|---|
| Min | 0.500000 | 0.500000 | 0.500000 |
| Slope | 0.001525 | 0.001000 | 0.002000 |

| Time In Transient (ms) | Sqr Function | Sqr Function | Sqr Function |
|---|---|---|---|
| 0 | 0.50 | 0.50 | 0.50 |
| 100 | 0.52 | 0.51 | 0.54 |
| 200 | 0.59 | 0.54 | 0.66 |
| 300 | 0.71 | 0.59 | 0.86 |
| 400 | 0.87 | 0.66 | 1.14 |
| 500 | 1.08 | 0.75 | 1.50 |
| 600 | 1.34 | 0.86 | 1.94 |
| 700 | 1.64 | 0.99 | 2.46 |
| 800 | 1.99 | 1.14 | 3.06 |
| 900 | 2.38 | 1.31 | 3.74 |
| 1000 | 2.83 | 1.50 | 4.50 |
| 1100 | 3.31 | 1.71 | 5.34 |
| 1200 | 3.85 | 1.94 | 6.26 |
| 1300 | 4.43 | 2.19 | 7.26 |
| 1400 | 5.06 | 2.46 | 8.34 |
| 1500 | 5.73 | 2.75 | 9.50 |
| 1600 | 6.45 | 3.06 | 10.74 |
| 1700 | 7.22 | 3.39 | 12.06 |
| 1800 | 8.04 | 3.74 | 13.46 |
| 1900 | 8.90 | 4.11 | 14.94 |
| 2000 | 9.80 | 4.50 | 16.50 |
| 2100 | 10.76 | 4.91 | 18.14 |
| 2200 | 11.76 | 5.34 | 19.86 |
| 2300 | 12.80 | 5.79 | 21.66 |
| 2400 | 13.90 | 6.26 | 23.54 |
| 2500 | 15.04 | 6.75 | 25.50 |
| 2600 | 16.22 | 7.26 | 27.54 |
| 2700 | 17.45 | 7.79 | 29.66 |
| 2800 | 18.73 | 8.34 | 31.86 |

ROBUST NOISE ESTIMATION

PRIORITY CLAIM

This application claims the benefit of priority from U.S. Provisional Application No. 60/800,221, filed May 12, 2006, entitled Robust Noise Estimation, which is incorporated herein by reference.

BACKGROUND OF THE INVENTION

1. Technical Field

This invention relates to noise, and more particularly, to a system that estimates noise.

2. Related Art

Some communication devices receive and transfer speech. Speech signals may pass from one system to another through a communication medium. In some systems, speech clarity depends on the level of noise that accompanies the signal. These systems may estimate noise by measuring noise levels at specific times. Poor performance in some systems may be caused by the time varying characteristics of noise that sometimes masks speech.

In other systems, noise is monitored during pauses in speech. When a pause occurs, an average noise condition is recorded. Through spectral subtraction an average noise level is removed to improve the perceived quality of the signal. In vehicles and other dynamic-noise environments, systems may not identify noise, especially noise that occurs during speech. A sudden change in a noise level that occurs, for example, when a window opens, a defrosting system turns on, or when a road transitions from asphalt to concrete may not be identified, especially if those changes occur when someone is speaking.

Some alternative systems track minimum noise thresholds. When no signal content is detected, noise is monitored and a minimum noise threshold is adjusted. If sudden changes in noise levels occur, some systems adjust the minimum noise threshold to match the change in noise levels. These systems may offer improved performance in high signal to noise conditions but suffer when the systems attempt to remove speech that may occur, for example, in echo cancellation. In some systems, echoes are replaced with comfort noise that tracks the minimum noise thresholds. In a worst case scenario, the perceived quality of speech may drop as the background noise tracks the fluctuating noise thresholds. There is a need for a system that improves noise estimates.

SUMMARY

An enhancement system improves the estimate of noise from a received signal. The system includes a spectrum monitor that divides a portion of the signal at more than one frequency resolution. Adaptation logic derives a noise adaptation factor of a received signal. One or more devices track the characteristics of an estimated noise in the received signal and modify multiple noise adaptation rates. Logic applies the modified noise adaptation rates derived from the signal divided at a first frequency resolution to the signal divided at a second frequency resolution.

An enhancement method estimates noise from a received signal. The method divides a portion of a received signal into wide bands and narrow bands and may normalize an estimate of the received signal into an approximately normal distribution. The method derives a noise adaptation factor of the received signal and modifies a plurality of noise adaptation rates based on spectral characteristics, using statistics such as variances, and temporal characteristics. The method modifies the plurality of noise adaptation rates and narrow band noise estimates based on trend characteristics and the modified noise adaptation rates.

Other systems, methods, features, and advantages of the invention will be, or will become, apparent to one with skill in the art upon examination of the following figures and detailed description. It is intended that all such additional systems, methods, features, and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE INVENTION

An enhancement method improves background noise estimates, and may improve speech reconstruction. The enhancement method may adapt quickly to sudden changes in noise. The method may track background noise during continuous or non-continuous speech. Some methods are very stable during high signal-to-noise conditions. Some methods have low computational complexity and memory requirements that may minimize cost and power consumption.

In communication methods, noise may comprise unwanted signals that occur naturally or are generated or received by a communication medium. The level and amplitude of the noise may be stable. In some situations, noise levels may change quickly. Noise levels and amplitudes may change in a broad band fashion and may have many different structures such as nulls, tones, and step functions. One method classifies background noise and speech through spectral analysis and the analysis of temporal variability.

Figure 1:
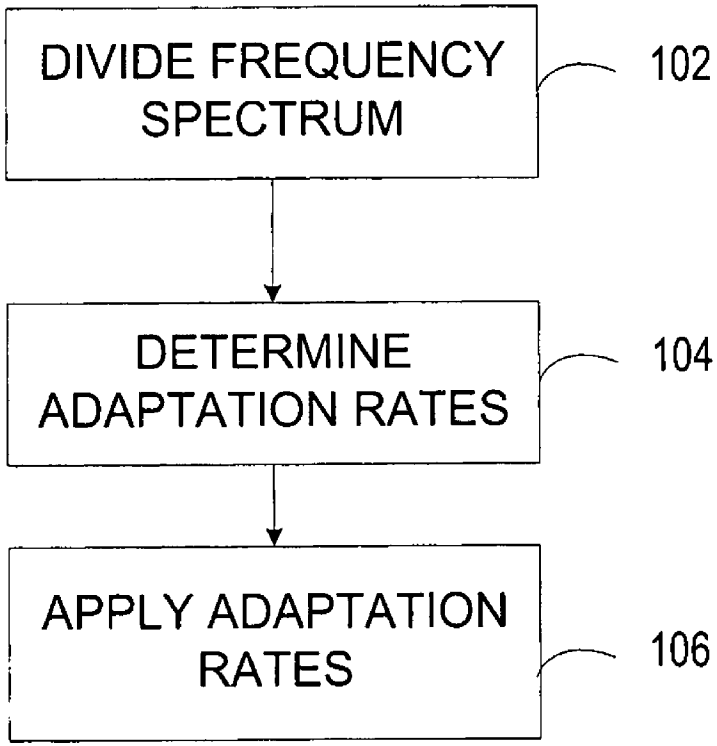
FIG. 1 is a flow diagram of an enhancement method.

To analyze spectral variability or other properties of noise, a frequency spectrum may be divided at more than one frequency resolution as described in FIG. 1. Some enhancement systems analyze signals at one frequency resolution and modify the signals at a second frequency resolution. For example, signals may be analyzed and/or modified in narrow bands (that may comprise uncompressed frequency bins) based on the observed characteristics of the signals in wide bands. A wide band may comprise a predetermined number of bands (e.g., about four to about six bands in some methods) that may be substantially equally spaced or differentially spaced such as logarithmic, Mel, or Bark scaled, and may be non-overlapping or overlapping. For optimization, some wide bands may have different bin resolutions and/or some narrow bands may have different resolutions. An upper frequency band may have a greater width than a lower frequency band. The resolution may be dictated by characteristics and timing of speech or background noise: for example, in some systems the width of the wide bands captures voiced formants. With the frequency spectrum divided into wide bands and narrow band bins at 102, normalizing logic may convert the signal and noise to a near normal distribution or other preferred distribution before logic performs analysis on characteristics of the wide bands to modify noise adaptation rates of selected wide bands at 104. An initial noise adaptation rate may be pre-programmed or may be derived from a portion of the frequency spectrum through logic. Wide band noise adaptation rates may then be applied to the narrow band bins at 106.

The wide band noise adaptation rates may be modified by one logical device or multiple logical devices or modules programmed or configured with functions that may track characteristics of the estimated noise and some may compensate for inexact changes to the wide band noise adaptation rates. In FIG. 1 the single or multiple logical devices may comprise one or more of noise-as-an-estimate-of-the-signal logic, temporal variability logic, time in transient logic, and/or peer pressure logic, some of which, for example, may be programmed with inverse square functions. Because each wide band noise adaptation rate may not be equally important to each narrow band bin, a function may apply the wide band noise adaptation rates of the wide bands that correspond to each of the narrow band bins. In some situations, where the adaptation rates are not equally important to each narrow band bin, weighting logic may be used that is configured or programmed with a triangular, rectangular, or other forms or combinations of weighting functions, for example.

Figure 2:
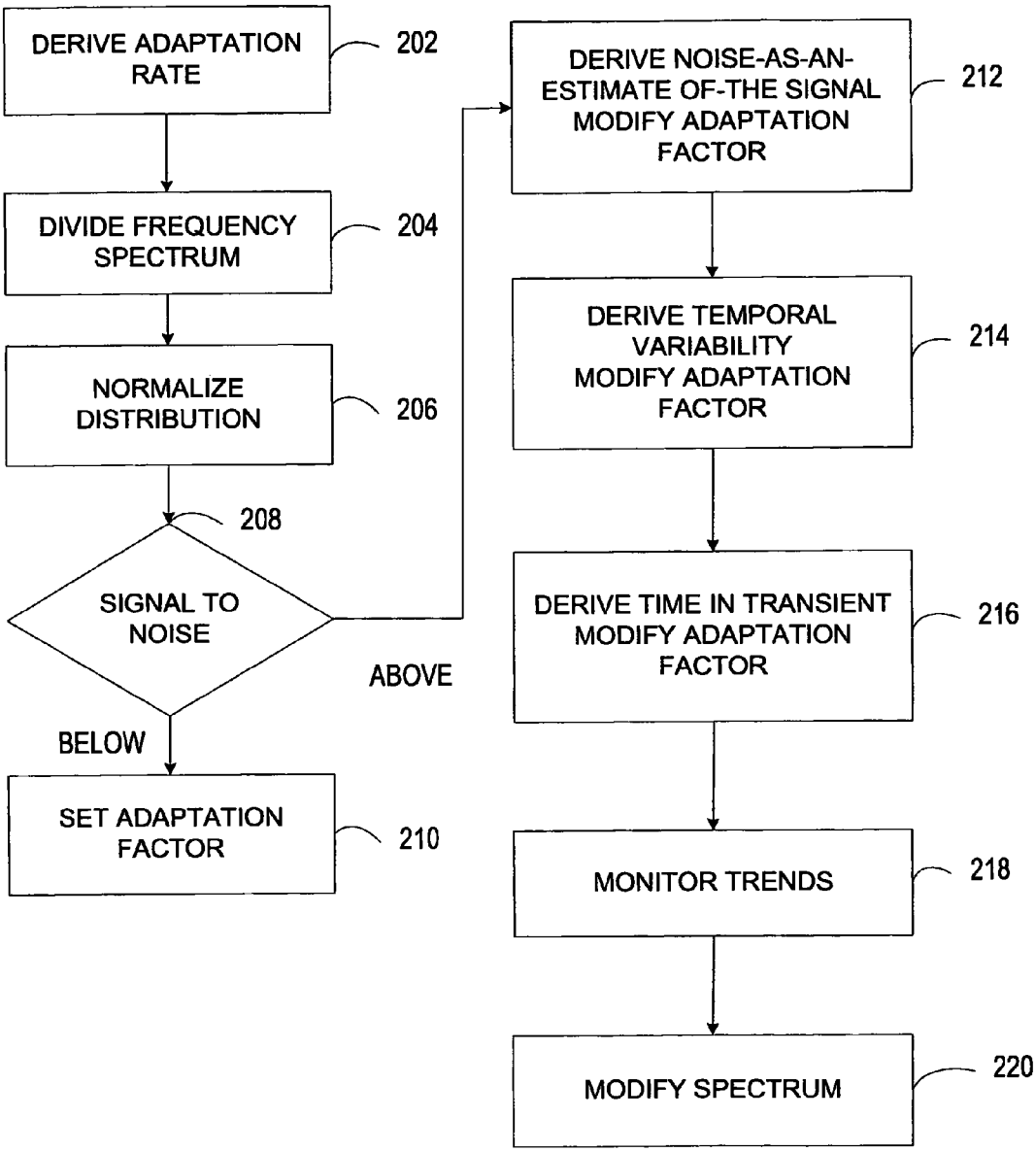
FIG. 2 is a flow diagram of an alternate enhancement method.

FIG. 2 illustrates an enhancement method 200 of estimating noise. The method may encompass software that may reside in memory or programmed hardware in communication with one or more processors. The processors may run one or more operating systems or may not run on an operating system. The method modifies a global adaptation rate for each wideband. The global adaptation rate may comprise an initial adjustment to the respective wideband noise estimates that is derived or set.

Some methods derive a global adaptation rate at 202. The methods may operate on a temporal block-by-block basis with each block comprising a time frame. When the number of frames is less than a pre-programmed or pre-determined number (e.g., about two in some methods) of frames, an enhancement method may derive an initial noise estimate by applying a successive smoothing function to a portion of the signal spectrum. In some methods the spectrum may be smoothed more than once (e.g., twice, three times, etc.) with a two, three, or more point smoothing function. When the number of frames is greater than or equal to the pre-programmed or predetermined number of frames, an initial noise estimate may be derived through a leaky integration function with a fast adapting rate, an exponential averaging function, or some other function. The global adaptation rate may comprise the difference in signal strength between the derived noise estimate and the portion of the spectrum within the frames.

Using a windowing function that may comprise equally spaced substantially rectangular windows that do not overlap or Mel spaced overlapping widows, the frequency spectrum is divided into a predetermined number of wide bands at 204. With the global adaptation rate automatically derived or manually set, the enhancement method analyzes the characteristics of the original signal through statistical methods. The average signal and noise power in each wide band may be calculated and converted into decibels (dB). The difference between the average signal strength and noise level in the power domain comprises the Signal to Noise Ratio (SNR). If an estimate of the signal strength and the noise estimates are equal or almost equal in a wide band, no further statistical analysis is performed on that wide band. The statistical results such as the variance of the SNR. (e.g., noise-as-an-estimate-of-the-signal), temporal variability, or other measures, for example, may be set to a pre-determined or minimum value before a next wide band is processed. If there is little or no difference between the signal strength and the noise level, some methods do not incur the processing costs of gathering further statistical information.

Figure 3:
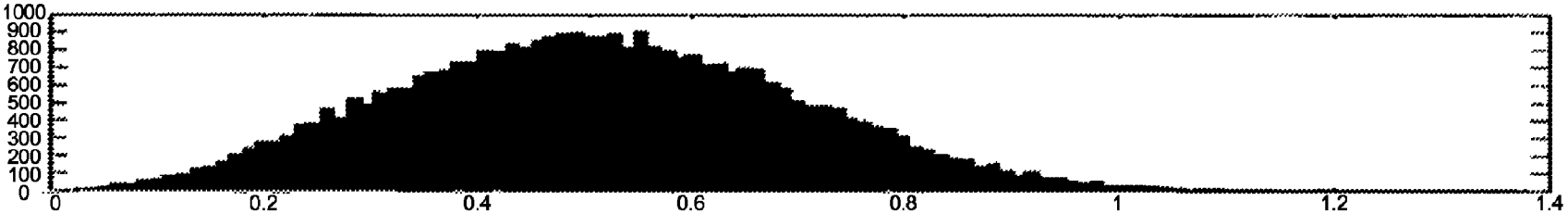
FIG. 3 is a cube root of a noise in the frequency domain.
Figure 4:
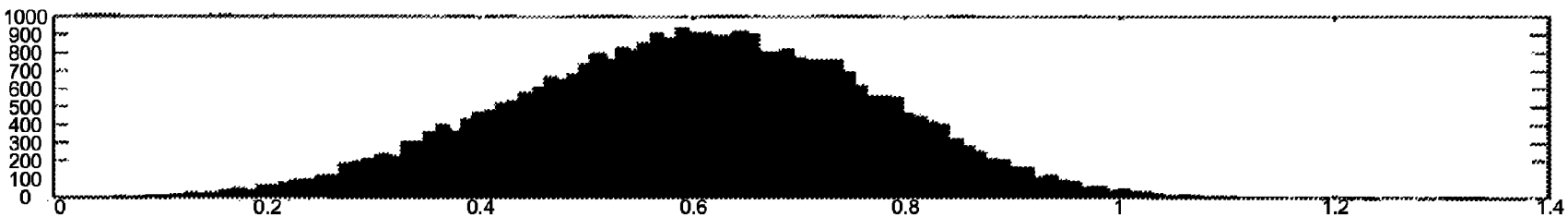
FIG. 4 is a quad root of a noise in the frequency domain.

In wide bands containing meaningful information between the signal and the noise estimate (e.g., having power ratios that exceed a predetermined level) some methods convert the signal and noise estimate to a near normal standard distribution or a standard normal distribution at 206. In a normal distribution a SNR calculation and gain changes may be calculated through additions and subtractions. If the distribution is negatively skewed, some methods convert the signal to a near normal distribution. One method approximates a near normal distribution by averaging the signal with a previous signal in the power domain before the signal is converted to dB. Another method compares the power spectrum of the signal with a prior power spectrum. By selecting a maximum power in each bin and then converting the selections to dB, this alternate method approximates a standard normal distribution. A cube root (P^⅓) or quad root (P^¼) of power shown in FIG. 3 and FIG. 4, respectively, are other alternatives that may approximate a standard normal distribution.

For each wide band, the enhancement method may analyze spectral variability by calculating the sum and sum of the squared differences of the signal strength and the estimated noise level. A sum of squares may also be calculated if variance measurements are needed. From these statistics the noise-as-an-estimate-of-the-signal may be calculated. The noise-as-an-estimate-of-the-signal may be the variance of the SNR. There are many other different ways to calculate the variance of a given random variable in alternate methods. Equation 1 shows one method of calculating the variance of the SNR estimate across all "i" bins of a given wide band "j".

$$V_j = \frac{\sum_{0}^{N-1}(S_i - D_i)^2}{N} - \left(\frac{\sum_{0}^{N-1} S_i - \sum_{0}^{N-1} D_i}{N}\right)^2 \qquad \text{equation 1}$$

In equation 1, $V_j$ is the variance of the estimated SNR, $S_i$ is the value of the signal in dB at bin "i" within wide band "j," and $D_i$ is the value of the noise (or disturbance) in dB at bin "i" within wide band "j." D comprises the noise estimate. The subtraction of the squared mean difference between S and D comprise the normalization factor, or the mean difference between S and D. If S and D have a substantially identical shape, then V will be zero or approximately zero.

A leaky integration function may track each wide band's average signal content. In each wide band, a difference between the unsmoothed and smoothed values may be calculated. The difference, or residual (R) may be calculated through equation 2.

$$R=(S-\overline{S}) \quad \text{equation 2}$$

In equation 2, S comprises the average power of the signal and $\overline{S}$ comprises the temporally smoothed signal, which initializes to S on first frame.

Next, a temporal smoothing occurs, using a leaky integrator, where the adaptation rate is programmed to follow changes in the signal at a slower rate than the change that may be seen in voiced segments:

$$\overline{S}(n+1)=\overline{S}(n)+SBAdaptRate*R \quad \text{equation 3}$$

In equation 3, $\overline{S}$ (n+1) is the updated, smoothed signal value, $\overline{S}$ (n) is the current smoothed signal value, R comprises the residual and the SBAdaptRate comprises the adaptation rate initialized at a predetermined value. While the predetermined value may vary and have different initial values, one method initialized SBAdaptRate to about 0.061.

Once the temporally smoothed signal, $\overline{S}$, is calculated, the difference between the average or ongoing temporal variability and any changes in this difference (e.g., the second derivative) may be calculated. The temporal variability, TV, measures the variability of the how much the signal fluctuates as it evolves over time. The temporal variability may be calculated by equation 4.

$$TV(n+1)=TV(n)+TVAdaptRate*(R^2-TV( \quad \text{equation 4}$$

In equation 4, TV(n+1) is the updated value, TV(n) is the current value, R comprises the residual and TVAdaptRate comprises the adaptation rate initialized to a predetermined value. While the predetermined value may also vary and have different initial values, one method initialized the TVAdaptRate to about 0.22.

The length of time a wide band signal estimate lies above the wide band's noise estimate may also be tracked in some enhancement methods. If the signal estimate remains above the noise estimate by a predetermined level, the signal estimate may be considered "in transient" if it exceeds that predetermined level for a length of time. The time in transient may be monitored by a counter that may be cleared or reset when the signal estimate falls below that predetermined level or another appropriate threshold. While the predetermined level may vary and have different values with each application, one method pre-programmed the level to about 2.5 dB. When the SNR in the wide band fell below that level, the counter was reset.

Using the numerical description of each wide band such as those derived above, the enhancement method modifies wide band adaptation factors for each of the wide bands, respectively. Each wide band adaptation factor may be derived from the global adaptation rate. In some enhancement methods, the global adaptation rate may be derived, or alternately, preprogrammed to a predetermined value such as about 4 dB/second. This means that with no other modifications a wide band noise estimate may adapt to a wide band signal estimate at an increasing rate or a decreasing rate of about 4 dB/sec or the predetermined value.

Before modifying a wide band adaptation factor for the respective wide bands, the enhancement method determines if a wide band signal is below its wide band noise estimate by a predetermined level at 208, such as about −1.4 dB. If a wide band signal lies below the wide band noise estimate, the wide band adaptation factor may be programmed to a predetermined rate or function of a negative SNR at 210. In some enhancement methods, the wide band adaptation factor may be initialized to "−2.5×SNR." This means that if a wide band signal is about 10 dB below its wide band noise estimate, then the noise estimate should adapt down at a rate that is about twenty five times faster than its unmodified wide band adaptation rate in some methods. Some enhancement methods limit adjustments to a wide band's adaptation factor. Enhancement methods may ensure that a wide band noise estimate that lies above a wide band signal will not be positioned below (e.g., will not undershoot) the wide band signal when multiplied by a modified wide band adaptation factor.

If a wide band signal exceeds its wide band noise estimate by a predetermined level, such as about 1.4 dB, the wide band adaptation factor may be modified by two, three, four, or more factors. In the enhancement method shown in FIG. 2, noise-as-an-estimate-of-the-signal, temporal variability, time in transient, and peer pressure may affect the adaptation rates of each of the wide bands, respectively.

When determining whether a signal is noise or speech, the enhancement method may determine how well the noise estimate predicts the signal. If the noise estimate were shifted or scaled to the signal, then the average of the squared deviation of the signal from the estimated noise determines whether the signal is noise or speech. If the signal comprises noise then the deviations may be small. If the signal comprises speech then the deviations may be large. Statistically, this may be similar to the variance of the estimated SNR. If the variance of the estimated SNR is small, then the signal likely contains only noise. On the other hand, if the variance is large, then the signal likely contains speech. The variances of the estimated SNR across all of the wide bands could be subsequently combined or weighted and then compared to a threshold to give an indication of the presence of speech. For example, an A-weighting or other type of weighting curve could be used to combine the variances of the SNR across all of the wide bands into a single value. This single, weighted variance of the SNR estimate could then be directly compared, or temporally smoothed and then compared, to a predetermined or possibly dynamically derived threshold to provide a voice detection capability.

The multiplication factor of the wide band adaptation factor may also comprise a function of the variance of the estimated SNR. Because wide band adaptation rates may vary inversely with fit, a wideband adaptation factor may, for example, be multiplied by an inverse square function of the noise-as-an-estimate-of-the-signal at 212. The function returns a factor that is multiplied with the wide band's adaptation factor, yielding a modified wide band adaptation factor.

Figure 5:
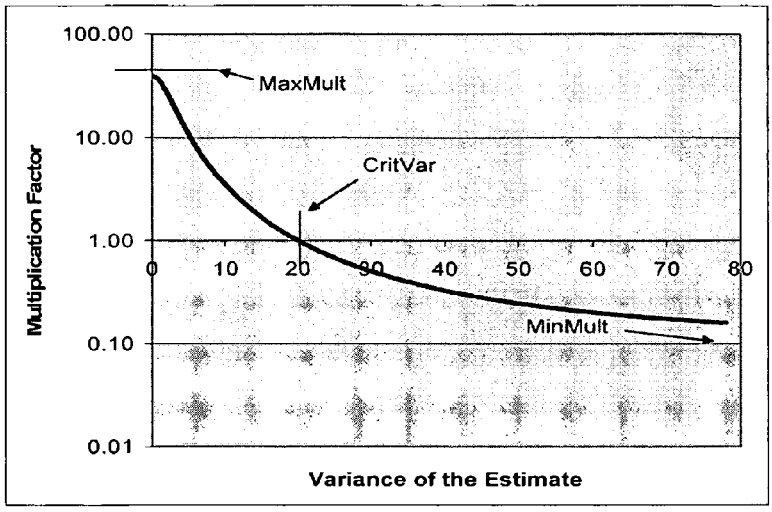
FIG. 5 is an inverse square function of a noise-as-an-estimate-of-the-signal.

As the variance of the estimated SNR increases, modifications to the adaptation rate would slow adaptation, because the signal and the offset noise estimate are dissimilar. As the variance decreases, the multiplier increases adaptation because the current signal is perceived to be a closer match to the current noise estimate. Since some noise may have a variance in the estimated SNR of about 20 to about 30—depending upon the statistic or numerical value calculated—an identity multiplier, representing the point where the function returns a multiplication factor of about 1.0, may be positioned within that range or near its limits. In FIG. 5 the identity multiplier is positioned at a variance of the estimates of about 20.

A maximum multiplier comprises the point where the signal is most similar to the noise estimate, hence the variance of the estimated SNR is small. It allows a wide band noise estimate to adapt to sudden changes in the signal, such as a step function, and stabilize during a voiced segment. If a wide band signal makes a significant jump, such as about 20 dB within one of the wide bands, for example, but closely resembles an offset wide band noise estimate, the adaptation rate increases quickly due to the small amount of variation and dispersions between the signal and noise estimates. A maximum multiplication factor may range from about 30 to about 50 or may be positioned near the limits of these ranges. In alternate enhancement methods, the maximum multiplier may have any value significantly larger than 1, and could vary, for example, with the units used in the signal and noise estimates. The value of the maximum multiplication factor could also vary with the actual use of the noise estimate, balancing temporal smoothness of the wide band background signal and speed of adaptation or another characteristic or combination of characteristics. A typical maximum multiplication factor would be within a range from about 1 to about 2 orders of magnitude larger than the initial wide band adaptation factor. In FIG. 5 the maximum multiplier comprises a programmed multiplier of about 40 at a variance of the estimate that approaches 0.

A minimum multiplier comprises the point where the signal varies substantially from the noise estimate, hence the variance of the estimated SNR is large. As the dispersion or variation between the signal and noise estimates increases, the multiplier decreases. A minimum multiplier may have any value within the range from 1 to 0, with one common value being in the range of about 0.1 to about 0.01 in some methods. In FIG. 5, the minimum multiplier comprises a multiplier of about 0.1 at a variance estimate that approaches about 80. In alternate enhancement methods the minimum multiplier is initialized to about 0.07.

Using the numerical values of the identity multiplier, maximum multiplier, and minimum multiplier, the inverse square function of the noise-as-an-estimate-of-the-signal may be derived from equation 5.

$$\text{Min} + \frac{\text{Range}}{1 + \text{Alpha} * \left(\frac{V}{CritVar}\right)^2} \qquad \text{equation 5}$$

In equation 5, V comprises the variance of the estimated SNR, Min comprises the minimum multiplier, Range comprises the maximum multiplier less the minimum multiplier, the CritVar comprises the identity multiplier, and Alpha comprises equation 6.

$$\frac{\text{Range}}{1 - \text{Min}} - 1 \qquad \text{equation 6}$$

When each of the wide band adaptation factors for each wide band has been modified by the function of the noise-as-an-estimate-of-the-signal (e.g., variance of the SNR), the modified wide band adaptation factors may be multiplied by an inverse square function of the temporal variability at 214. The function of FIG. 6 returns a factor that is multiplied against the modified wide band factors to control the speed of adaptation in each wide band. This measure comprises the variability around a smooth wideband signal. A smooth wide band noise estimate may have variability around a temporal average close to zero but may also range in strength between 6 $dB^2$ to about 8 $dB^2$ while still being typical background noise. In speech, temporal variability may approach levels between about 100 $dB^2$ to about 400 $dB^2$. Similarly, the function may be characterized by three independent parameters comprising an identity multiplier, maximum multiplier, and a minimum multiplier.

Figure 6:
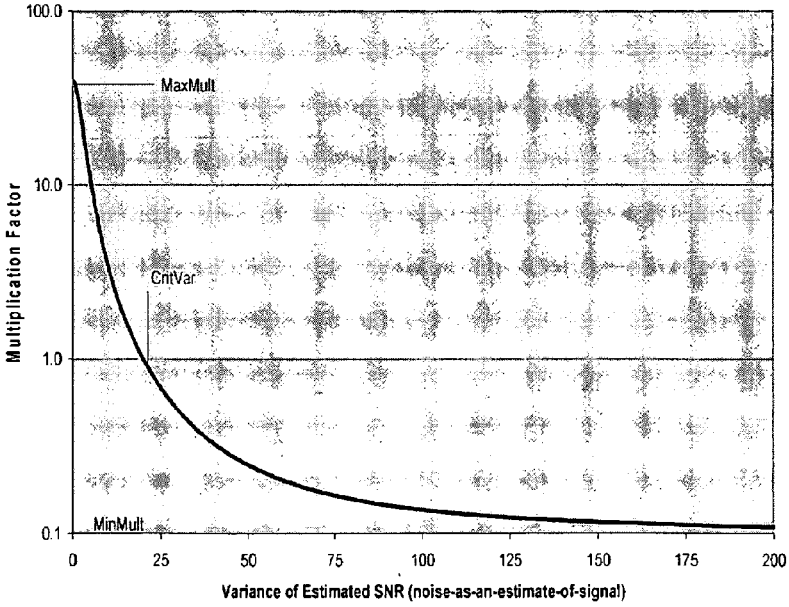
FIG. 6 is an inverse square function of a temporal variability.

The identity multiplier for the inverse square temporal variability function comprises the point where the function returns a multiplication factor of 1.0. At this point temporal variability has minimal or no effect on a wide band adaptation rate. Relatively high temporal variability is a possible indicator of the presence of speech in the signal, so as the temporal variability increases, modifications to the adaptation rate would slow adaptation. As the temporal variability of the signal decreases, the adaptation rate multiplier increases because the signal is perceived to be more likely noise than speech. Since some noise may have a variability about a best fit line from a variance estimate of about 5 to about 15 $dB^2$, an identity multiplier may be positioned within that range or near its limits. In FIG. 6, the identity multiplier is positioned at a variance of the estimate of about 8. In alternate enhancement methods the identity multiplier may be positioned at a variance of the estimate of about 10.

A maximum multiplication factor may range from about 30 to about 50 or may be positioned near the limits of these ranges. In alternate enhancement methods, the maximum multiplier may have any value significantly larger than 1, and could vary, for example, with the units used in the signal and noise estimates. The value of the maximum multiplication factor could also vary with the actual use of the noise estimate, balancing temporal smoothness of the wide band background signal and speed of adaptation. A typical maximum multiplication factor would be within a range from about 1 to about 2 orders of magnitude larger than the initial wide band adaptation. In FIG. 6, the maximum multiplier comprises a programmed multiplier of about 40 at a temporal variability that approaches about 0.

A minimum multiplier comprises the point where the temporal variability of any particular wide band is comparatively large, possibility signifying the presence of voice or highly transient noise. As the temporal variability of the wide band estimate increases, the multiplier decreases. A minimum multiplier may have any value within the range from about 1 to about 0 or near this range, with a common value being in the range of about 0.1 to about 0.01 or at or near this range. In FIG. 6, the minimum multiplier comprises a multiplier of about 0.1 at a variance estimate that approaches about 80. In alternate enhancement systems the minimum multiplier is initialized to about 0.07

Figure 7:
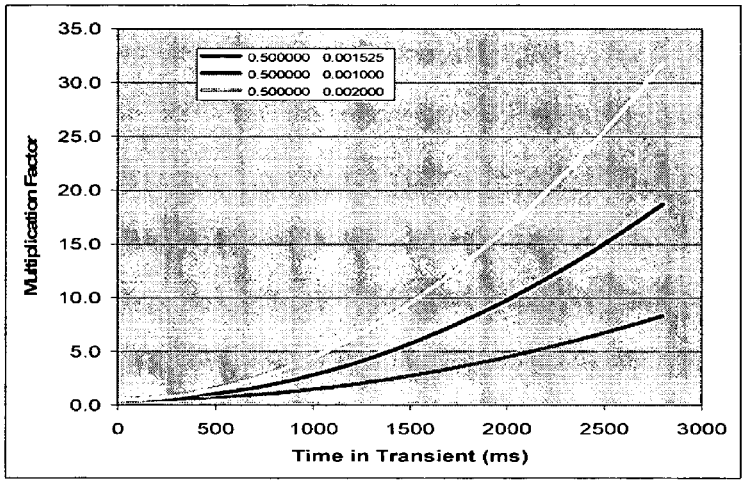
FIG. 7 is a plurality of time in transient functions.

When each of the wide band adaptation factors for each wide band have been modified by the function of temporal variability, the modified wide band adaptation factors are multiplied by a function correlated to the amount of time a wide band signal estimate has been above a wide band estimate noise level by a predetermined level, such as about 2.5 dB (e.g., the time in transient) at 216. The multiplication factors shown in FIG. 7 are initialized at a low predetermined value such as about 0.5. This means that the modified wide band adaptation factor adapts slower when the wide band signal is initially above the wide band noise estimate. The partial parabolic shape of each of the time in transient functions adapt faster the longer the wide band signal exceeds the wide band noise estimate by a pre-determined level. Some time in transient functions may have no upper limits or very high limits so that the enhancement method may compensate for inappropriate or inexact reductions in the wide band adaptation factors applied by another factor such as the noise-as-an-estimate-of-the-signal function and/or the temporal variability function in this enhancement method for example. In some enhancement methods the inverse square functions of noise-as-an-estimate-of-the-signal and/or the temporal variability may reduce the adaptation multiplier when it is not appropriate. This may occur when a wide band noise estimate jumps, a comparison made with the noise-as-an-estimate-of-the-signal indicates that the wide band noise estimates are very different, and/or when the wide band noise estimate is not stable, yet still contain only background noise.

While any number of time in transient functions may be selected and applied, three exemplary time in transient functions are shown in FIG. 7. Selection of a function may depend on the application of the enhancement method and characteristics of the wide band signal and/or wide band noise estimate. At about 2.5 seconds in FIG. 7, for example, the upper time in transient function adapts almost 30 times faster than the lower time in transient function. The exemplary functions may be derived by equation 7.

$$F=\text{Min}+(\text{Slope}*\text{Time})^2 \qquad \text{equation 7}$$

In equation 7, Min comprises the minimum transient adaptation rate, Time accumulates the length of time each frame a wide band is greater than a predetermined threshold, and Slope comprises the initial transient slope. In one enhancement method Min was initialized to about 0.5, the predetermined threshold of Time was initialized to about 2.5 dB, and the Slope was initialized to about 0.001525 with Time measured in milliseconds.

When each of the wide band adaptation factors for each wide band have been modified by one or more of spectral shape similarity (e.g., variance of the estimated SNR), temporal variability, and time in transient, the overall adaptation factor for any wide band may be limited. In one implementation of the enhancement method, the maximum multiplier is limited to about 30 dB/sec. In alternate enhancement methods the minimum multiplier may be given different limits for rising and falling adaptations, or may only be limited in one direction, for example limiting a wideband to rise no faster than about 25 dB/sec, but allowing it to fall at as much as about 40 dB/sec.

With the modified wide band adaptation factors derived for each wide band, there may be wide bands where the wide band signal is significantly larger than the wide band noise. Because of this difference, the inverse square functions of the noise-as-an-estimate-of-the-signal function and the temporal variability function, and the time in transient function may not always accurately predict the rate of change of wide band noise in those high SNR bands. If the wide band noise estimate is dropping in some neighboring low SNR wide bands, then some enhancement methods may determine that the wide band noise in the high SNR wide bands is also dropping If the wide band noise is rising in some neighboring low SNR wide bands, some or the same enhancement methods may determine that the wide band noise may also be rising in the high SNR wide bands.

To identify trends, some enhancement methods monitor the low SNR bands to identify peer pressure trends at 218. The optional method may first determine a maximum noise level across the low SNR wide bands (e.g., wide bands having an SNR<about 2.5 dB). The maximum noise level may be stored in a memory. The use of a maximum noise level on another high SNR wide band may depend on whether the noise in the high SNR wide band is above or below the maximum noise level.

In each of the low SNR bands, the modified wide band adaptation factor is applied to each member bin of the wide band. If the wide band signal is greater than the wide band noise estimate, the modified wide band adaptation factor is added, otherwise, it is subtracted. This temporary calculation may be used by some enhancement methods to predict what may happen to the wide band noise estimate when the modified adaptation factor is applied. If the noise increases a predetermined amount (e.g., such as about 0.5 dB) then the modified wide band adaptation factor may be added to a low SNR gain factor average. A low SNR gain factor average may be an indicator of a trend of the noise in wide bands with low SNR or may indicate where the most information about the wide band noise may be found.

Next, some enhancement methods identify wide bands that are not considered low SNR and in which the wide band signal has been above the wide band noise for a predetermined time. In some enhancement methods the predetermined time may be about 180 milliseconds. For each of these wide bands, a Peer-Factor and a Peer-Pressure is computed. The Peer-Factor comprises a low SNR gain factor, and the Peer-Pressure comprises an indication of the number of wide bands that may have contributed to it. For example, if there are 6 widebands and all but 1 have low SNR, and all 5 low SNR peers contain a noise signal that is increasing, then some enhancement methods may conclude that the noise in the high SNR band is rising and has a relatively high Peer-Pressure. If only 1 band has a low SNR then all the other high SNR bands would have a relatively low Peer-Pressure influence factor.

With the adapted wide band factors computed, and with the Peer-Factor and Peer-Pressure computed, some enhancement methods compute the modified adaptation factor for each narrow band bin at 220. Using a weighting function, the enhancement method assigns a value that comprises a weighted value of the parent wide band and its closest neighbor or neighbors. This may comprise an overlapping triangular or other weighting factor. Thus, if one bin is on the border of two wide bands then it could receive half or about half of the wide band adaptation factor from the lower band and half or about half the wide band adaptation factor from the higher band, when one exemplary triangular weighting function is used. If the bin is in almost the exact center of a wide band it may receive all or nearly all of its weight from a parent wide band.

At first a frequency bin may receive a positive adaptation factor, which may be eventually added to the noise estimate. But if the signal at that narrow band bin is below the wide band noise estimate then the modified wide band adaptation factor for that narrow band bin may be made negative. With the positive or negative characteristic determined for each frequency bin adaptation factor, the PeerFactor is blended with the bin's adaptation factor at the PeerPressure ratio. For example, if the PeerPressure was only ⅙ then only $\frac{1}{6}^{th}$ of the adaptation factor for a given bin is determined by its peers. With each adaptation factor determined for each narrow band bin (e.g., positive or negative dB values for each bin), these values, which may represent a vector, are added to the narrow band noise estimate.

To ensure accuracy, some enhancement methods may ensure that the narrow band noise estimate does not fall beyond a predetermined floor, such as about 0 dB. Some enhancement methods convert the narrow band noise estimate to amplitude. While any method may be used, the enhancement method may make the conversion through a lookup table, or a macro command, a combination, or another method. Because some narrow band noise estimates may be measured through a median filter function in dB and the prior narrow band noise amplitude estimate may be calculated as a mean in amplitude, the current narrow band noise estimate may be shifted by a predetermined level. One enhancement method may temporarily shift the narrow band noise estimate by a predetermined amount such as about 1.75 dB in one application to match the average amplitude of a prior narrow band noise estimate on which other thresholds may be based. When integrated within a noise reduction module, the shift may be unnecessary.

The power of the narrow band noise may be computed as the square of the amplitudes. For subsequent processes, the narrow band spectrum may be copied to the previous spectrum or stored in a memory for use in the statistical calculations. As a result of these optional acts, the narrow band noise estimate may be calculated and stored in dB, amplitude, or power for any other method or system to use. Some enhancement methods also store the wideband structure in a memory so that other systems and methods have access to wideband information. For example, a Voice Activity Detector (VAD) could indicate the presence of speech within a signal by deriving a temporally smoothed, weighted sum of the variances of the wide band SNR, and by comparing that derived value against a threshold.

The above-described method may also modify a wide band adaptation factor, a wide band noise estimate, and/or a narrow band noise estimate through a temporal inertia modification in an alternate enhancement method. This alternate method may modify noise adaptation rates and noise estimates based on the concept that some background noises, like vehicle noises, may be thought of as having inertia. If over a predetermined number of frames, such as about 10 frames for example, a wide band or narrow band noise has not changed, then it is more likely to remain unchanged in the subsequent frames. If over the predetermined number of frames (e.g., about 10 frames in this application) the noise has increased, then the next frame may be expected to be even higher in some alternate enhancement methods. And, if after the predetermined number of frames (e.g., about 10 frames) the noise has fallen, then some enhancement methods may modify the modified wide band adaptation factor lower. This alternate enhancement method may extrapolate from the previous predetermined number of frames to predict the estimate within a current frame. To prevent overshoot, some alternate enhancement methods may also limit the increases or decreases in an adaptation factor. This limiting could occur in measured values such as amplitude (e.g., in dB), velocity (e.g., in dB/sec), acceleration (e.g., in dB/sec$^2$), or in any other measurement unit. These alternate enhancement methods may provide a more accurate noise estimate when someone is speaking in motion, such as when a driver may be speaking in a vehicle that may be accelerating.

Each of the enhancement methods or individual acts that comprise the methods described may be encoded in a signal bearing medium, a computer readable medium such as a memory, programmed within a device such as one or more integrated circuits, or processed by a controller or a computer. If the acts that comprise the methods are performed by software, the software may reside in a memory resident to or interfaced to a noise detector, processor, a communication interface, or any other type of non-volatile or volatile memory interfaced or resident to an enhancement system. The memory may include an ordered listing of executable instructions for implementing logical functions. A logical function or any system element described may be implemented through optic circuitry, digital circuitry, through source code, through analog circuitry, through an analog source such as an analog electrical, audio, or video signal or a combination. The software may be embodied in any computer-readable or signal-bearing medium, for use by, or in connection with an instruction executable system, apparatus, or device. Such a system may include a computer-based system, a processor-containing system, or another system that may selectively fetch instructions from an instruction executable system, apparatus, or device that may also execute instructions.

A "computer-readable medium," "machine readable medium," "propagated-signal" medium, and/or "signal-bearing medium" may comprise any device that contains, stores, communicates, propagates, or transports software for use by or in connection with an instruction executable system, apparatus, or device. The machine-readable, medium may selectively be, but not limited to, an electronic, magnetic, optical, electromagnetic, infrared, or semiconductor system, apparatus, device, or propagation medium. A non-exhaustive list of examples of a machine-readable medium would include: an electrical connection "electronic" having one or more wires, a portable magnetic or optical disk, a volatile memory such as a Random Access Memory "RAM" (electronic), a Read-Only Memory "ROM" (electronic), an Erasable Programmable Read-Only Memory (EPROM or Flash memory) (electronic), or an optical fiber (optical). A machine-readable medium may also include a tangible medium upon which software is printed, as the software may be electronically stored as an image or in another format (e.g., through an optical scan), then compiled, and/or interpreted or otherwise processed. The processed medium may then be stored in a computer and/or machine memory.

Figure 8:
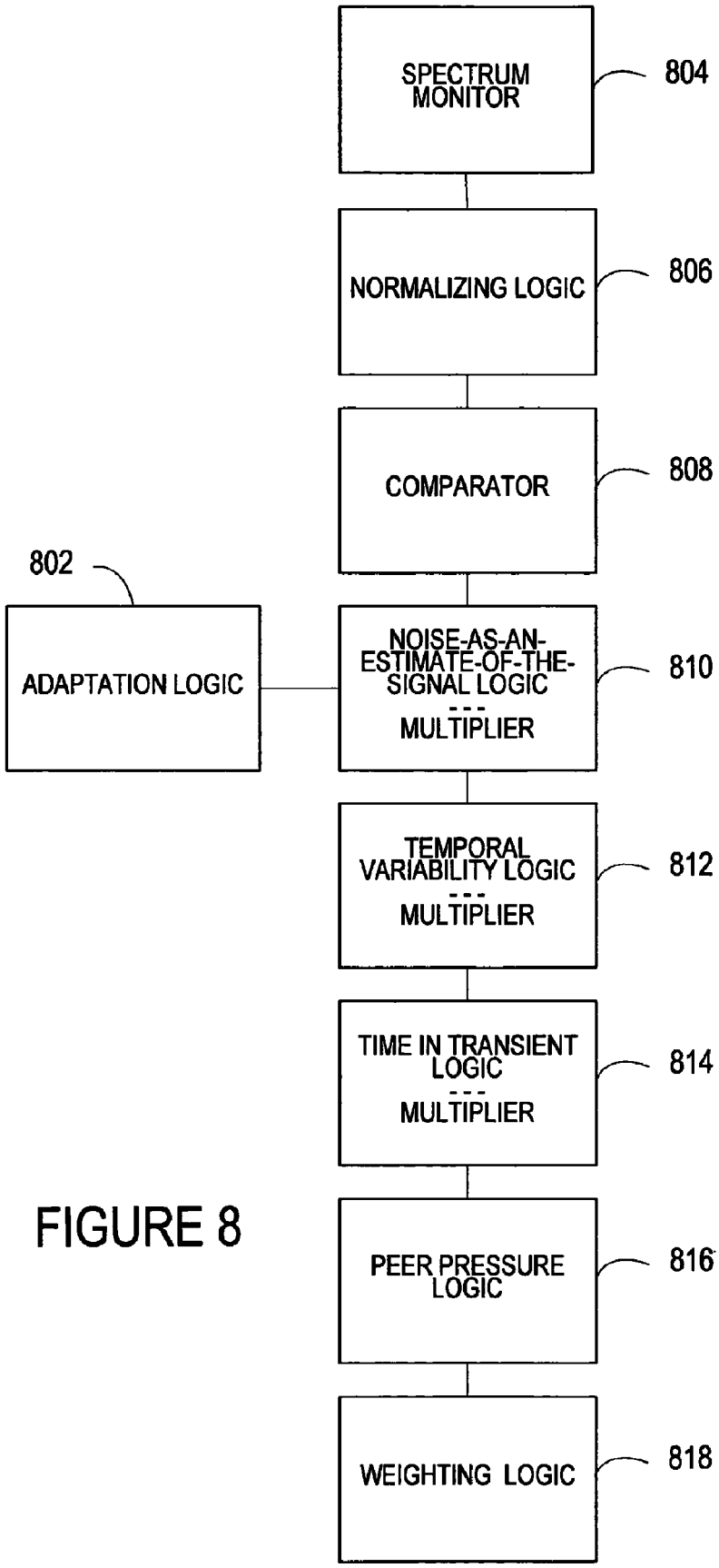
FIG. 8 is a block diagram of an enhancement system.

FIG. 8 illustrates an enhancement system 800 of estimating noise. The system may encompass logic or software that may reside in memory or programmed hardware in communication with one or more processors. In software, the term logic refers to the operations performed by a computer; in hardware the term logic refers to hardware or circuitry. The processors may run one or more operating systems or may not run on an operating system. The system modifies a global adaptation rate for each wideband. The global adaptation rate may comprise an initial adjustment to the respective wideband noise estimates that is derived or set.

Some enhancement systems derive a global adaptation rate using global adaptation logic 802. The global adaptation logic may operate on a temporal block-by-block basis with each block comprising a time frame. When the number of frames is less than a pre-programmed or pre-determined number (e.g., about two) of frames, the global adaptation logic may derive an initial noise estimate by applying a successive smoothing function to a portion of the signal spectrum. In some systems the spectrum may be smoothed more than once (e.g., twice, three times, etc.) with a two, three, or more point smoothing device. When the number of frames is greater than or equal to the pre-programmed or predetermined number of frames, an initial noise estimate may be derived through a leaky integrator programmed or configured with a fast adapting rate or an exponential averager within or coupled to the global adaptation logic 802. The global adaptation rate may comprise the difference in signal strength between the derived noise estimate and the portion of the spectrum within the frames.

Using a windowing function that may comprise equally spaced substantially rectangular windows that do not overlap or Mel spaced overlapping widows, the frequency spectrum is divided into a predetermined number of wide bands through a spectrum monitor 804. With the global adaptation rate automatically derived or manually set by the global adaptation logic, the enhancement system may analyze the characteristics of the original signal using statistical systems. The average signal and noise power in each wide band may be calculated and converted into decibels (dB) by a converter. The difference between the average signal strength and noise level in the power domain comprises the Signal to Noise Ratio (SNR). If a comparator within or coupled to the spectrum monitor 804 determines that an estimate of the signal strength and the noise estimates are equal or almost equal in a wide band no further statistical analysis is performed on that wide band. The statistical results such as the variance of the SNR, (e.g., noise-as-an-estimate-of-the-signal), temporal variability, or other measures, for example, may be set to a predetermined or minimum value before a next wide band is received by the normalizing logic 806. If there is little or no difference between the signal strength and the noise level, some systems do no incur the processing costs of gathering further statistical information.

In wide bands containing meaningful information between the signal and the noise estimate (e.g., having power ratios that exceed a predetermined level) some systems convert the signal and noise estimate to a near normal standard distribution or a standard normal distribution using normalizing logic 806. In a normal distribution a SNR calculation and gain changes may be calculated through additions and subtractions. If the distribution is negatively skewed some systems convert the signal to a near normal distribution. One system approximates a near normal distribution by averaging the signal with a previous signal in the power domain using averaging logic before the signal is converted to dB. Another system compares the power spectrum of the signal with a prior power spectrum using a comparator. By selecting a maximum power in each bin and then converting the selections to dB, this alternate system approximates a standard normal distribution. A cube root (P^⅓) or quad root (P^¼) of power shown in FIG. 3 and FIG. 4, respectively, are other alternatives that may be programmed within the normalizing logic 806 that may approximate a standard normal distribution.

For each wide band, the enhancement system may analyze spectral variability by calculating the sum and sum of the squared differences of the estimated signal strength and the estimated noise level using a processor or controller. A sum of squares may also be calculated if variance measurements are needed. From these statistics the noise-as-an-estimate-of-the-signal may be calculated. The noise-as-an-estimate-of-the-signal may be the variance of the SNR. Even though alternate systems calculate the variance of a given random variable many different ways, equation 1 shows one way of calculating the variance of the SNR estimate across all "i" bins of a given wide band "j."

$$V_j = \frac{\sum_{0}^{N-1}(S_i - D_i)^2}{N} - \left(\frac{\sum_{0}^{N-1} S_i - \sum_{0}^{N-1} D_i}{N}\right)^2 \qquad \text{equation 1}$$

In equation 1, $V_j$ is the variance of the estimated SNR, $S_i$ is the value of the signal in dB at bin "i" within wide band "j," and $D_i$ is the value of the noise (or disturbance) in dB at bin "i" within wide band "j." D comprises the noise estimate. The subtraction of the squared mean difference between S and D comprise the normalization factor, or the mean difference between S and D. If S and D have a substantially identical shape, then V will be zero or approximately zero.

A leaky integrator may track each wide band's average signal content. In each wide band, the difference between the unsmoothed and smoothed values may be calculated. The difference, or residual (R) may be calculated through equation 2.

$$R=(S-\overline{S}) \qquad \text{equation 2}$$

In equation 2, S comprises the average power of the signal and $\overline{S}$ comprises the temporally smoothed signal, which initializes to S on first frame.

Next, a smoothing occurs through a leaky integrator, $\overline{S}$, where the adaptation rate is programmed to follow changes in signal at a slower rate than the change that may be seen in voiced segments:

$$\overline{S}(n+1)=\overline{S}(n)+SBAdaptRate*R \qquad \text{equation 3}$$

In equation 3, $\overline{S}$ (n+1) is the updated, smoothed signal value, $\overline{S}$ (n) is the current smoothed signal value, R comprises the residual and the SBAdaptRate comprises the adaptation rate initialized at a predetermined value. While the predetermined value may vary and have different initial values, one system initialized SBAdaptRate to about 0.061.

Once the temporally smoothed signal, $\overline{S}$, is calculated, the difference between the average or ongoing temporal variability and any changes in this difference (e.g., the second derivative) may be calculated through a subtractor. The temporal variability, TV, measures the variability of the how much the signal fluctuates as it evolves over time. The temporal variability may be calculated by equation 4.

$$TV(n+1)=TV(n)+TVAdaptRate*(R^2-TV( \qquad \text{equation 4}$$

In equation 4, TV(n+1) is the updated value, TV(n) is the current value, R comprises the residual and TVAdaptRate comprises the adaptation rate initialized to a predetermined value. While the predetermined value may also vary and have different initial values, one system initialized the TVAdaptRate to about 0.22.

The length of time a wide band signal estimate lies above the wide band's noise estimate may also be tracked in some enhancement systems. If the signal estimate remains above the noise estimate by a predetermined level, the signal estimate may be considered "in transient" if it exceeds that predetermined level for a length of time. The time in transient may be monitored by a counter coupled to a memory that may be cleared or reset when the signal estimate falls below that predetermined level, or another appropriate threshold. While the predetermined level may vary and have different values with each application, one system pre-programmed the level to about 2.5 dB. When the SNR in the wide band fell below that level, the counter and memory was reset.

Using the numerical description of each wide band such as those derived above, the enhancement system modifies wide band adaptation factors for each of the wide bands, respectively. Each wide band adaptation factor may be derived from the global adaptation rate generated by the global adaptation logic 802. In some enhancement systems, the global adaptation rate may be derived, or alternately, pre-programmed to a predetermined value.

Before modifying a wide band adaptation factor for the respective wide bands, some enhancement systems determines if a wide band signal is below its wide band noise estimate by a predetermined level, such as about −1.4 dB, using a comparator 808. If a wide band signal lies below the wide band noise estimate, the wide band adaptation factor may be programmed to a predetermined rate or function of a negative SNR. In some enhancement systems, the wide band adaptation factor may be initialized or stored in memory at a value of "−2.5×SNR." This means that if a wide band signal is about 10 dB below its wide band noise estimate, then the noise estimate should adapt down at a rate that is about twenty five times faster than its unmodified wide band adaptation rate. Some enhancement systems limit adjustments to a wide band's adaptation factor. Enhancement systems may ensure that a wide band noise estimate that lies above a wide band signal will not be positioned below (e.g., will not undershoot) the wide band signal when multiplied by a modified wide band adaptation factor.

If a wide band signal exceeds its wide band noise estimate by a predetermined level, such as about 1.4 dB, the wide band adaptation factor may be modified by two, three, four, or more logical devices. In the enhancement system shown in FIG. 8, noise-as-an-estimate-of-the-signal logic, temporal variability logic, time in transient logic, and peer pressure logic may affect the adaptation rates of each of the wide bands, respectively.

When determining whether a signal is noise or speech, the enhancement system may determine how well the noise estimate predicts the signal. That is, if the noise estimate were shifted or scaled to the signal by a level shifter, then the average of the squared deviation of the signal from the estimated noise determines whether the signal is noise or speech If the signal comprises noise then the deviations may be small. If the signal comprises speech then the deviations may be large. If the variance of the estimated SNR is small, then the signal likely contains only noise. On the other hand, if the variance is large, then the signal likely contains speech. The variances of the estimated SNR across all of the wide bands may be subsequently combined or weighted through logic and then compared through a comparator to a threshold to give an indication of the presence of speech. For example, an A-weighting or other weighting logic could be used to combine the variances of the SNR across all of the wide bands into a single value. This single, weighted variance of the SNR estimate could then be directly compared through a comparator, or temporally smoothed by logic and then compared, to a predetermined or possibly dynamically derived threshold to provide a voice detection capability.

The multiplication factor of the wide band adaptation factor may also comprise a function of the variance of the estimated SNR. Because wide band adaptation rates may vary inversely with fit, a wideband adaptation factor may, for example, be multiplied by an inverse square function configured in the noise-as-an-estimate-of-the-signal logic 810. The noise-as-an-estimate-of-the-signal logic 810 returns a factor that is multiplied with the wide band's adaptation factor through a multiplier, yielding a modified wide band adaptation factor.

As the variance of the estimated SNR increases modifications to the adaptation rate would slow adaptation, because the signal and offset wide band noise estimate are not similar. As the variance decreases the multiplier increases adaptation because the current signal is perceived to be a closer match to the current noise estimate. Since some noise may have a have a variance in the estimated SNR of about 20 to about 30-depending upon the statistic being calculated—an identity multiplier, representing the point where the function returns a multiplication factor of about 1.0 may positioned within that range or near its limits. In FIG. 5 the identity multiplier is positioned at a variance of the estimates of about 20.

A maximum multiplier comprises the point where the signal is most similar to the noise estimate, hence the variance of the estimated SNR is small. It allows a wide band noise estimate to adapt to sudden changes in the signal, such as a step function, and stabilize during a voiced segment. If a wide band signal makes a significant jump, such as about 20 dB within one of the wide bands, for example, but closely resembles an offset wide band noise estimate, the adaptation rate increases quickly due to the small amount of variation and dispersions between the signal and noise estimates. A maximum multiplication factor may range from about 30 to about 50 or may be positioned near the limits of these ranges. In alternate enhancement systems, the maximum multiplier may have any value significantly larger than 1, and could vary, for example, with the units used in the signal and noise estimates. The value of the maximum multiplication factor could also vary with the actual use of the noise estimate, balancing temporal smoothness of the wide band background signal and speed of adaptation. A common maximum multiplication factor may be within a range from about 1 to about 2 orders of magnitude larger than the initial wide band adaptation factor. In FIG. 5 the maximum multiplier comprises a programmed multiplier of about 40 at a variance of the estimate that approaches 0.

A minimum multiplier comprises the point where the signal varies substantially from the noise estimate, hence the variance of the estimated SNR is large. As the dispersion or variation between the signal and noise estimate increases, the multiplier decreases. A minimum multiplier may have any value within the range from 1 to 0, with a one common value being in the range of about 0.1 to about 0.01 in some systems. In FIG. 5, the minimum multiplier comprises a multiplier of about 0.1 at a variance estimate that approaches about 80. In alternate enhancement systems the minimum multiplier is initialized to about 0.07.

Using the numerical values of the identity multiplier, maximum multiplier, and minimum multiplier the inverse square function programmed or configured in the noise-as-an-estimate-of-the-signal logic 810 may comprise equation 5.

$$\mathrm{Min} + \frac{\mathrm{Range}}{1 + \mathrm{Alpha} * \left(\frac{V}{CritVar}\right)^2} \qquad \text{equation 5}$$

In equation 5, V comprises the variance of the estimated SNR, Min comprises the minimum multiplier, Range comprises the maximum multiplier less the minimum multiplier, the CritVar comprises the identity multiplier, and Alpha comprises equation 6.

$$\frac{\mathrm{Range}}{1 - \mathrm{Min}} - 1 \qquad \text{equation 6}$$

When each of the wide band adaptation factors for each wide band have been modified by the function programmed or configured in the noise-as-an-estimate-of-the-signal logic 810, the modified wide band adaptation factors may be multiplied by an function programmed or configured in the temporal variability logic 812 by a multiplier. The function of FIG. 6 returns a factor that is multiplied against the modified wide band factors to control the speed of adaptation in each wide band. This measure comprises the variability around a smooth wideband signal. A smooth wide band noise estimate may have a variability around a temporal average close to zero but may also range in strength between $dB^2$ to about 8 $dB^2$ while still being typical background noise. In speech, temporal variability may approach levels between about 100 $dB^2$ to about 400 $dB^2$. Similarly, the function may be characterized by three independent parameters comprising an identity multiplier, maximum multiplier, and a minimum multiplier.

The identity multiplier for the inverse square programmed in the temporal variability logic 812 comprises the point where the logic returns a multiplication factor of 1.0. At this point temporal variability has minimal or no effect on a wide band adaptation rate. Relatively high temporal variability is a possible indicator of the presence of speech in the signal, so as the temporal variability increases modifications to the adaptation rate would slow adaptation. As the temporal variability of the signal decreases the adaptation rate multiplier increases because the signal is perceived to be more likely to be noise than speech. Since some noise may have a variability about a best fit line from a variance estimate of about 5 $dB^2$ to about 15 $dB^2$, an identity multiplier may positioned within that range or near its limits. In FIG. 6, the identity multiplier is positioned at a variance of the estimate of about 8. In alternate enhancement systems the identity multiplier may be positioned at a variance of the estimate of about 10.

A maximum multiplication factor may ranges from about 30 to about 50 or may be positioned near the limits of these ranges. In alternate enhancement systems, the maximum multiplier may have any value significantly larger than 1, and could vary, for example, with the units used in the signal and noise estimates. The value of the maximum multiplication factor could also vary with the actual use of the noise estimate, balancing temporal smoothness of the wide band background signal and speed of adaptation. A typical maximum multiplication factor would be within a range from about 1 to 2 orders of magnitude larger than the initial wide band adaptation factor. In FIG. 6, the maximum multiplier comprises a programmed multiplier of about 40 at a temporal variability that approaches about 0.

A minimum multiplier comprises the point where the temporal variability of any particular wide band is comparatively large, possibility signifying the presence of voice or highly transient noise. As the temporal variability of the wide band energy estimate increases the multiplier decreases. A minimum multiplier may have any value within the range from about 1 to about 0, or near this range with a common value being in the range of about 0.1 to about 0.01 or at or near this range. In FIG. 6, the minimum multiplier comprises a multiplier of about 0.1 at a variance estimate that approaches 80. In alternate enhancement systems the minimum multiplier is initialized to about 0.07

When each of the wide band adaptation factors for each wide band have been modified by the function programmed or configured in the temporal variability logic 812, the modified wide band adaptation factors are multiplied by a time in transient logic 814 programmed or configured with a function correlated to the amount of time a wide band signal estimate has been above a wide band estimate noise level by a predetermined level, such as about 2.5 dB (e.g., the time in transient) through a multiplier. The multiplication factors shown in FIG. 7 are initialized at a low predetermined value such as about 0.5. This means that the modified wide band adaptation factor adapts slower when the wide band signal is initially above the wide band noise estimate. The partial parabolic shape of each of the time in the functions programmed or configured in the time in transient logic 814 adapt faster the longer the wide band signal exceeds the wide band noise estimate by a pre-determined level. Some time in transient logic 814 may be programmed or configured with functions that may have no upper limits or very high limits so that the enhancement system may compensate for inappropriate or inexact reductions in the wide band adaptation factors applied by other logic such as the noise-as-an-estimate-of-the-signal logic 810 and/or the temporal variability logic 812 in this enhancement system 800 for example. In some enhancement systems the inverse square functions programmed within or configured in the noise-as-an-estimate-of-the-signal logic 810 and/or the temporal variability logic 812 may reduce the adaptation multiplier when it is not appropriate. This may occur when a wide band noise estimate jumps, a comparison made by the noise-as-an-estimate-of-the-signal logic 810 may indicate that the wide band noise estimates are very different, and/or when the wide band noise estimate is not stable, yet still contain only background noise.

While any number of time in transient functions may be programmed or configured in the time in transient logic 814 and then selected and applied in some enhancement systems, three exemplary time in transient functions that may be programmed within or configured within the time in transient logic 814 are shown in FIG. 7. Selection of a function within the logic may depend on the application of the enhancement system and characteristics of the wide band signal and/or wide band noise estimate. At about 2.5 seconds in FIG. 7, for example, the upper time in transient function adapts almost 30 times faster than the lower time in transient function. Some of the functions programmed within or configured in the time in transient logic 814 may be derived by equation 7.

$$F=\text{Min}+(\text{Slope}*\text{Time})^2 \qquad \text{equation 7}$$

In equation 7, Min comprises the minimum transient adaptation rate, Time accumulates the length of time each frame a wide band is greater than a predetermined threshold, and Slope comprises the initial transient slope. In one enhancement system Min was initialed to about 0.5, the predetermined threshold of Time was initialed to about 2.5 dB, and the Slope was initialized to about 0.001525, with Time measured in milliseconds.

When each of the wide band adaptation factors for each wide band have been modified by one or more of shape similarity (variance of the estimated SNR), temporal variability, and time in transient, the overall adaptation factor for any wide band may be limited. In one implementation of the enhancement systems the, maximum multiplier is limited to about 30 dB/sec. In alternate enhancement systems the minimum multiplier may be given different limits for rising and falling adaptations, or may only be limited in one direction, for example limiting a wideband to rise no faster than about 25 dB/sec, but allowing it to fall at as much as about 40 dB/sec.

With the modified wide band adaptation factors derived for each wide band, there may be wide bands where the wide band signal is significantly larger than the wide band noise. Because of this difference, the inverse square functions programmed or configured within the noise-as-an-estimate-of-the-signal logic 810 and the temporal variability logic 812, and the time in transient logic 814 may not always accurately predict the rate of change wide band noise in those high SNR bands. If the wide band noise estimate is dropping in some neighboring low SNR wide bands, then some enhancement systems may determine that the wide band noise in the high SNR wide bands is also dropping. If the wide band noise is rising in some neighboring low SNR wide bands, some or the same enhancement systems may determine that the wide band noise may also be rising in the high SNR wide bands.

To identify trends, some enhancement systems monitor the low SNR bands to identify trends through peer pressure logic 816. The optional part of the enhancement system 800 may first determine a maximum noise level across the low SNR wide bands (e.g., wide bands having an SNR<about 2.5 dB). The maximum noise level may be stored in a memory. The use of a maximum noise levels on another high SNR wide band may depend on whether the noise in the high SNR wide band is above or below the maximum noise level.

In each of the low SNR bands, the modified wide band adaptation factor is applied to each member bin of the wide band. If the wide band signal is greater than the wide band noise estimate, the modified wide band adaptation factor is added through an adder, otherwise, it is subtracted by a subtractor. This temporary calculation may be used by some enhancement systems to predict what may happen to the wide band noise estimate when the modified adaptation factor is applied. If the noise increases a predetermined amount (e.g., such as about 0.5 dB) then the modified wide band adaptation factor may be added to a low SNR gain factor average by the adder. A low SNR gain factor average may be an indicator of a trend of the noise in wide bands with low SNR or may indicate where the most information about the wide band noise may be found.

Next, some enhancement systems identify wide bands that are not considered low SNR and in which the wide band signal has been above the wide band noise for a predetermined time through a comparator. In some enhancement systems the predetermined time may be about 180 milliseconds. For each of these wide bands, a Peer-Factor and a Peer-Pressure is computed by the peer pressure logic 816 and stored in memory coupled to the peer pressure logic 816. The Peer-Factor comprises a low SNR gain factor, and the Peer-Pressure comprises an indication of the number of wide bands that may have contributed to it. For example, if there are 6 widebands and all but 1 have low SNR, and all 5 low SNR peers contain a noise signal that is increasing then some enhancement systems may conclude that the noise in the high SNR band is rising and has a relatively high Peer-Pressure. If only 1 band has a low SNR then all the other high SNR bands would have a relatively low Peer-Pressure.

With the adapted wide band factors computed, and with the Peer-Factor and Peer-Pressure computed, some enhancement systems compute the modified adaptation factor for each narrow band bin. Using a weighting logic 818, the enhancement system assigns a value that may comprise a weighted value of the parent band and neighboring bands. Thus, if one bin is on the border of two wide bands then it could receive half or about half of the wide band adaptation factor from the left band and half or about half the wide band adaptation factor from the right band, when one exemplary triangular weighting function is used. If the bin is in almost the exact center of a wide band it may receive all or nearly all of its weight from a parent band.

At first a frequency bin may receive a positive adaptation factor, which may be eventually added to the noise estimate. But if the signal at that narrow band bin is below the wide band noise estimate then the modified wide band adaptation factor for that narrow band bin may be made negative. With the positive or negative characteristic determined for each frequency bin adaptation factor, the PeerFactor is blended with the bin's adaptation factor at the PeerPressure ratio. For example, if the PeerPressure was only ⅙ then only $\frac{1}{6}^{th}$ of the adaptation factor for a given bin is determined by its peers. With each adaptation factor determined for each narrow band bins (e.g., positive or negative dB values for each bin) these values, which may represent a vector, are added to the narrow band noise estimate using an adder.

To ensure accuracy, some enhancement systems may ensure that the narrow band noise estimate does not fall beyond a predetermined floor, such as about 0 dB through a comparator. Some enhancement systems convert the narrow band noise estimate to amplitude. While any system may be used, the enhancement system may make the conversion through a lookup table, or a macro command, a combination, or another system. Because some narrow band noise estimates may be measured through a median filter in dB and the prior narrow band noise amplitude estimate may be calculated as a mean in amplitude, the current narrow band noise estimate may be shifted by a predetermined level through a level shifter. One enhancement system may temporarily shift the narrow band noise estimate using the level shifter whose function is to shift the narrow band noise estimate by a predetermined value, such as by about 1.75 dB to match the average amplitude of a prior narrow band noise estimate on which other thresholds may be based. When integrated within a noise reduction module, the shift may be unnecessary.

The power of the narrow band noise may be computed as the square of the amplitudes. For subsequent processes, the narrow band spectrum may be copied to the previous spectrum or stored in a memory for use in the statistical calculations. As a result, the narrow band noise estimate may be calculated and stored in dB, amplitude, or power for any other system or system to use. Some enhancement systems also store the wideband structure in a memory so that other systems and systems have access to wideband information. In some enhancement systems, for example, a Voice Activity Detector (VAD) could indicate the presence of speech within a signal by deriving a temporally smoothed, weighted sum of the variances of the wide band SNR, The above-described enhancement system may also modify a wide band adaptation factor, a wide band noise estimate, and/or a narrow band noise estimate through temporal inertia logic in an alternate enhancement system. This alternate system may modify noise adaptation rates and noise estimates based on the concept that some background noises, like vehicle noises may be though of as having inertia. If over a predetermined number of frames, such as 10 frames for example, a wide band or narrow band noise has not changed, then it is more likely to remain unchanged in the subsequent frames. If over the predetermined number of frames (e.g., 10 frames) the noise has increased, then the next frame may be expected to be even higher in some alternate enhancement systems and the temporal inertia logic increases the noise estimate in that frame. And, if after the predetermined number of frames (e.g., 10 frames) the noise has fallen, then some enhancement systems may modify the modified wide band adaptation factor and lower the noise estimate. This alternate enhancement system may extrapolate from the previous predetermined number of frames to predict the estimate within a current frame. To prevent overshoot, some alternate enhancement systems may also limit the increases or decreases in an adaptation factor. This limiting could occur in measured values such as amplitude (e.g., in dB), velocity (e.g. dB/sec), acceleration (e.g., dB/sec$^2$), or in any other measurement unit. These alternate enhancement systems may provide a more accurate noise estimate when someone is speaking in motion such as when a driver may be speaking in a vehicle which is accelerating.

Other alternative enhancement systems comprise combinations of the structure and functions described above. These enhancement systems are formed from any combination of structure and function described above or illustrated within the figures. The system may be implemented in logic that may comprise software that comprises arithmetic and/or non-arithmetic operations (e.g., sorting, comparing, matching, etc.) that a program performs or circuits that process information or perform one or more functions. The hardware may include one or more controllers, circuitry or a processors or a combination having or interfaced to volatile and/or non-volatile memory and may also comprise interfaces to peripheral devices through wireless and/or hardwire mediums.

Figure 9:
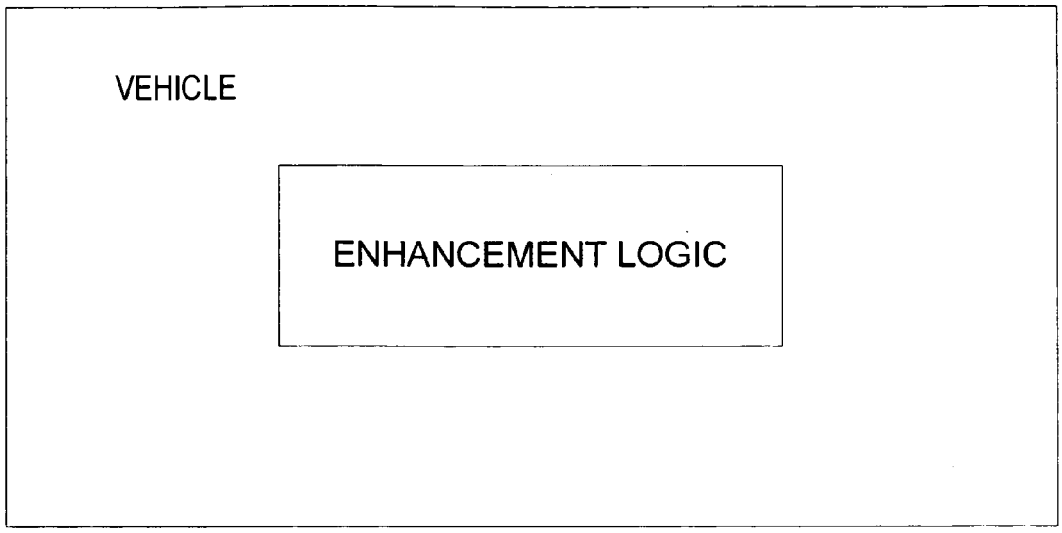
FIG. 9 is a block diagram of an enhancement system coupled to a vehicle.
Figure 10:
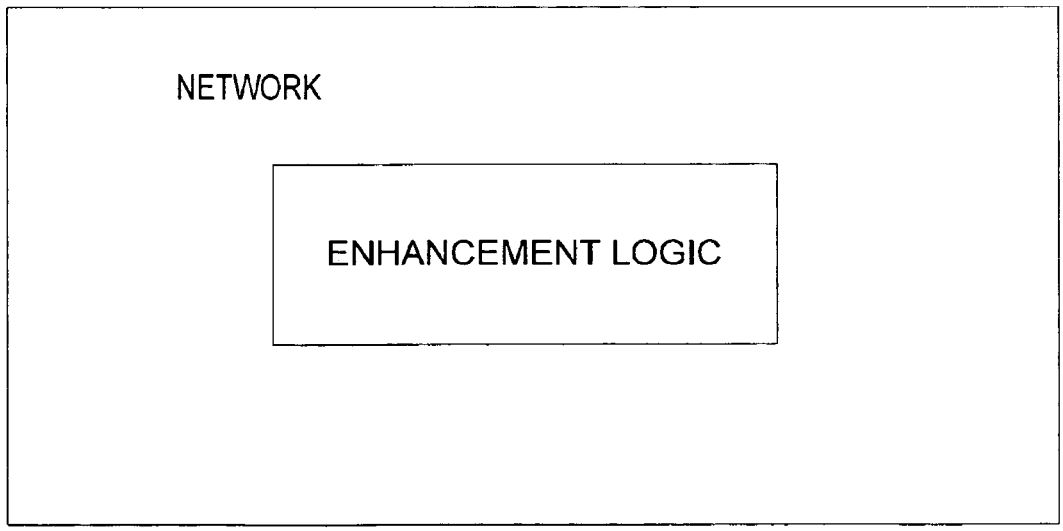
FIG. 10 is a block diagram of an enhancement system in communication with a network.
Figure 11:
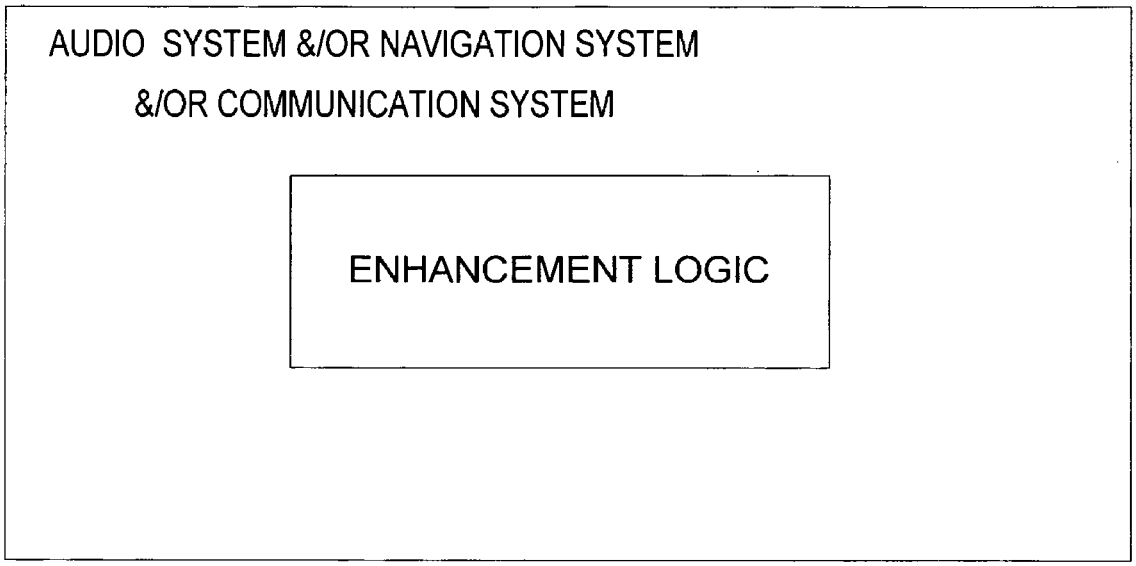
FIG. 11 is a block diagram of an enhancement system in communication with a telephone, navigation system, or audio system.

The enhancement system is easily adaptable to any technology or devices. Some enhancement systems or components interface or couple vehicles as shown in FIG. 9, publicly or privately accessible networks as shown in FIG. 10, instruments that convert voice and other sounds into a form that may be transmitted to remote locations, such as landline and wireless phones and audio systems as shown in FIG. 11, video systems, personal noise reduction systems, voice activated systems like navigation systems, and other mobile or fixed systems that may be susceptible to noises. The communication systems may include portable analog or digital audio and/or video players (e.g., such as an iPod®), or multimedia systems that include or interface speech enhancement systems or retain speech enhancement logic or software on a hard drive, such as a pocket-sized ultra-light hard-drive, a memory such as a flash memory, or a storage media that stores and retrieves data. The enhancement systems may interface or may be integrated into wearable articles or accessories, such as eyewear (e.g., glasses, goggles, etc.) that may include wire free connectivity for wireless communication and music listening (e.g., Bluetooth stereo or aural technology) jackets, hats, or other clothing that enables or facilitates hands-free listening or hands-free communication. The logic may comprise discrete circuits and/or distributed circuits or may comprise a processor or controller.

The enhancement system improves the similarities between reconstructed and unprocessed speech through an improved noise estimate. The enhancement system may adapt quickly to sudden changes in noise. The system may track background noise during continuous or non-continuous speech. Some systems are very stable during high signal-to-noise conditions when the noise is stable. Some systems have low computational complexity and memory requirements that may minimize cost and power consumption.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

I claim:

1. An enhancement system operative to estimate noise from a received signal comprising:

a spectrum monitor operative to divide a portion of a received signal at more than one frequency resolution;

a global adaptation logic operative to derive a noise adaptation factor of the received signal;

a plurality of logical devices programmed to track characteristics of an estimated noise in the received signal and modify a plurality of noise adaptation rates of portions of the received signal divided at a first frequency resolution;

a weighting logic applied to one or more of the tracked characteristics of the estimated noise in the received signal, the weighting logic being operative to derive a value that when compared to a predetermined threshold indicates a presence of speech; and a limiting logic operative to constrain the modified plurality of noise adaptation rates.

2. The system of claim 1 where the spectrum monitor is configured to divide the portion of the received signal into at least two frequency resolutions.

3. The system of claim 1 where some of the plurality of logical devices compensate for inexact changes to the modified plurality of noise adaptation rates.

4. The system of claim 1 where one of the plurality of logical devices comprises noise-as-an-estimate-of-the-signal logic.

5. The system of claim 1 where one of the plurality of logical devices comprises temporal variability logic.

6. The system of claim 1 where one of the plurality of logical devices comprises time in transient logic.

7. The system of claim 1 where one of the plurality of logical devices comprises peer pressure logic.

8. The system of claim 1 where one of the plurality of logical devices comprises a device operative to detect spectral changes through an inertial prediction.

9. The system of claim 1 where the weighting logic is further operative to derive a value from each of the weighted one or more of the tracked characteristics of the estimated noise in the received signal, that when compared to a predetermined threshold indicates a presence of speech.

10. The system of claim 1 where the weighting logic is applied to each of one or more of the tracked characteristics of the estimated noise in the received signal at each of the more than one frequency resolution, and the weighting logic is further operative to derive the value from the tracked characteristics of the estimated noise in the received signal at each of the more than one frequency resolution that when compared to the predetermined threshold indicates the presence of speech.

11. The system of claim 1 where the weighting logic comprises an A-weighting logic and a smoothing element operative to temporally smooth a noise-as-an-estimate-of-the-signal and to derive an indicator signal indicating the presence of speech.

12. The system of claim 1 further comprising a vehicle coupled to the spectrum monitor.

13. The system of claim 1 further comprising a voice activated system coupled to the spectrum monitor.

14. An enhancement system operative to estimate noise from a received signal comprising:

a spectrum monitor operative to divide a portion of a received signal into wide bands and narrow bands;

a global adaptation logic operative to derive a noise adaptation factor of the received signal;

a first and a second logic configured with inverse square functions operative to modify a plurality of noise adaptation rates based on a variance;

a third logic operative to modify the plurality of noise adaptation rates based on temporal characteristics;

a peer pressure logic operative to modify the plurality of noise adaptation rates and narrow band noise estimates based on trend characteristics and the modified noise adaptation rates of nearby wide bands and/or narrow bands; and a temporal inertia logic operative to modify the plurality of noise adaptation rates and narrow band noise estimates based on predicted adaptation trends.

15. The system of claim 14 where the first logic comprises noise-as-an-estimate-of-the-signal logic.

16. The system of claim 14 where the second logic comprises temporal variability logic.

17. The system of claim 14 where the third logic comprises time-in-transient logic.

18. The system of claim 14 where the temporal characteristics comprise an amount of time a wide band signal estimate has been above a wide band noise estimate by a predetermined level.

19. The system of claim 14 where the peer pressure logic comprises weighting logic.

20. An enhancement system operative to estimate noise from a received signal comprising:

a spectrum monitor operative to divide a portion of a received signal into wide bands and narrow bands;

a normalizing logic operative to convert an estimate of the received signal into a near normal distribution;

a global adaptation logic operative to derive a noise adaptation factor of the received signal; and means to modify wide band noise adaptation rates and narrow band noise estimates based on inverse square functions and temporal characteristics.

21. An enhancement method operative to estimate noise from a received signal comprising:

dividing a portion of a received signal into wide bands and narrow bands;

normalizing an estimate of the received signal into a near normal distribution;

deriving a noise adaptation factor of the received signal, where the noise adaptation factor is based on an inverse square function;

modifying a plurality of noise adaptation rates based on variances;

modifying the plurality of noise adaptation rates based on temporal characteristics; and modifying the plurality of noise adaptation rates and narrow band noise estimates based on trend characteristics and the modified noise adaptation rates.

22. The enhancement system of claim 20 where a variance corresponds to the inverse square functions.

* * * * *